US008867969B2

(12) United States Patent
Murata

(10) Patent No.: US 8,867,969 B2
(45) Date of Patent: Oct. 21, 2014

(54) ROTATION RESTRICTING MEMBER, MECHANICAL DEVICE, AND IMAGE FORMING DEVICE

(75) Inventor: Koji Murata, Osaka (JP)

(73) Assignee: Kyocera Document Solutions Inc. (JP)

( * ) Notice: Subject to any disclaimer, the term of this patent is extended or adjusted under 35 U.S.C. 154(b) by 111 days.

(21) Appl. No.: 13/638,174

(22) PCT Filed: Mar. 31, 2010

(86) PCT No.: PCT/JP2010/002391

§ 371 (c)(1),
(2), (4) Date: Sep. 28, 2012

(87) PCT Pub. No.: WO2011/121670

PCT Pub. Date: Oct. 6, 2011

(65) Prior Publication Data

US 2013/0028639 A1 Jan. 31, 2013

(51) Int. Cl.

| | |
|---|---|
| ***G03G 15/00*** | (2006.01) |
| ***G03G 15/08*** | (2006.01) |
| ***G03G 21/16*** | (2006.01) |

(52) U.S. Cl.

CPC ..... *G03G 21/1647* (2013.01); *G03G 15/0886* (2013.01); *G03G 2221/1657* (2013.01); *G03G 15/0834* (2013.01)

USPC ..... 399/260; 399/12; 399/119; 399/263

(58) Field of Classification Search

USPC ..... 399/260, 262, 107, 119, 110, 263, 12; 74/527

See application file for complete search history.

(56) References Cited

U.S. PATENT DOCUMENTS

2003/0123904 A1 * 7/2003 Maeshima et al. ..... 399/167

FOREIGN PATENT DOCUMENTS

| | | |
|---|---|---|
| JP | 06-176817 | 6/1994 |
| JP | 6-176817 | 6/1994 |
| JP | 2007-051744 | 3/2007 |
| JP | 2008-2338 | 1/2008 |
| JP | 2008-233862 | 10/2008 |
| JP | 2009-168856 | 7/2009 |
| JP | 2009-168858 | 7/2009 |

OTHER PUBLICATIONS

International Search Report and Written Opinion mailed May 11, 2010 in corresponding PCT International Application No. PCT/JP2010/002391.

* cited by examiner

*Primary Examiner* — Sophia S Chen
(74) *Attorney, Agent, or Firm* — Ostrolenk Faber LLP

(57) ABSTRACT

The present invention provides a rotation restricting member that includes, a shaft that is inserted into a shaft insertion hole with a predetermined angle relationship, and a plurality of rotation restriction portions, each of which is formed at a different position around the shaft insertion hole and performs a rotation restriction function of the shaft by engaging with an external portion, where the shaft insertion hole is set to have a shape of the shaft and is formed around the shaft with a different angle corresponding to the shape of the shaft to allow any of the plurality of rotation restriction portions to engage with the external portion.

10 Claims, 4 Drawing Sheets

ROTATION RESTRICTING MEMBER, MECHANICAL DEVICE, AND IMAGE FORMING DEVICE

CROSS-REFERENCE TO RELATED APPLICATIONS

The present application is a 35 U.S.C. §§371 national phase conversion of PCT/JP2010/002391, filed Mar. 31, 2010, the content of which is incorporated herein by reference. The PCT International Application was published in the Japanese language.

TECHNICAL FIELD

The present invention relates to a rotation restricting member, a mechanical device, and an image forming device.

BACKGROUND ART

In Japanese Unexamined Patent Application, First Publication No. 2009-168858, (hereinafter "JP 2009-168858"), a conventional technique regarding a toner container of a copy machine is disclosed. The toner container is structured in line with specifications according to a model of a copy machine, and supplies a contained toner to the copy machine such that a rotation shutter rotates and thus changes its state from a closing state to an opening state. A lock mechanism is attached to such a container in order for the rotation shutter to rotate only when the toner container is mounted on a compatible copy machine.

The lock mechanism is formed by a convex portion provided with a casing of the toner container, and a lock plate attached to a rotation shaft of the rotation shutter, and restricts rotation of the rotation shutter by the insertion of the convex portion into a locking hole formed on the lock plate. The lock plate described above is separately prepared according to the respective toner containers having different specifications (such as each having a different screw diameter). In a manufacturing setting, workers manufacture a toner container by attaching a lock plate thereto that is compatible to the specifications of the toner container.

Such copy machine (image forming device) and toner container are disclosed in detail in JP 2009-168858, for example.

DISCLOSURE OF INVENTION

Problems to be Solved by the Invention

In the conventional lock mechanism described above, since a lock plate needs to be prepared separately according to the specifications (such as each having a different screw diameter) of the toner container, the total cost increases. In order to avoid this cost increase, a common lock plate can be used for the toner containers with different specifications. In this case, however, the lock plate may be attached with an erroneous orientation with respect to a rotation shaft. That is, there is a problem of erroneous attachment. When such lock plates having different specifications are attached, the lock mechanism does not operate normally. Therefore, rotation of the rotation shutter cannot be restricted normally, and it causes a problem of, for example, leaking the toner to the external unit and the like.

In view of the circumstances described above, it is an object of the present invention to reduce the total cost and prevent erroneous attachment to reliably perform a rotation restricting function such as restricting the rotation of the rotation shutter and the like.

Means for Solving the Problems

In order to achieve the object described above, as a solution relating to a rotation restricting member, the present invention provides a rotation restricting member that includes, a shaft insertion hole that is set to have a shape corresponding to a shape of a shaft and into which the shaft is inserted with a predetermined angular relationship, and a plurality of rotation restriction portions, each of which is formed at a different position around the shaft insertion hole and performs a rotation restriction function of the shaft by engaging with an external portion, where the shaft insertion hole is formed around the shaft with a different angle corresponding to the shape of the shaft to allow any of the plurality of rotation restriction portions to engage with the external portion.

Effects of the Invention

According to a rotation restricting member, a mechanical device, and an image forming device of the present invention, it is possible to reliably perform a rotation restricting function by preventing erroneous attachment to a shaft.

EMBODIMENTS FOR CARRYING OUT THE INVENTION

Hereinbelow, with reference to the drawings, a preferred embodiment of the present invention is described.

Figure 1:
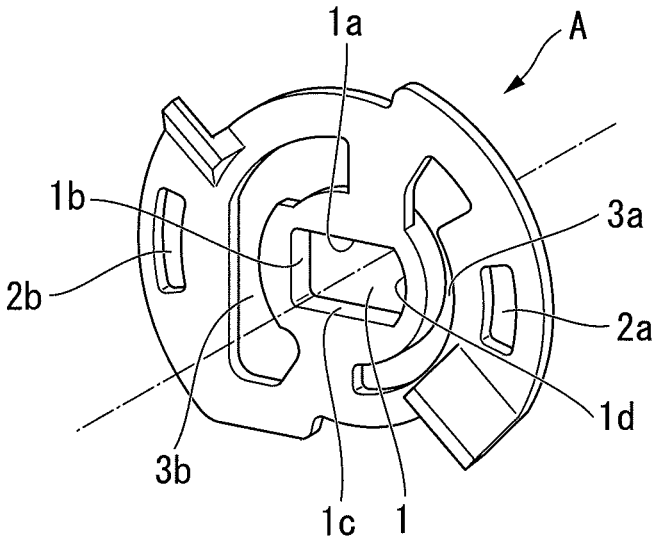
FIG. 1 is a perspective view showing a structure of a lock plate A (a rotation restricting member) according to a preferred embodiment of the present invention.

A lock plate A (a rotation restricting member) according the present preferred embodiment shown in FIG. 1 is an approximately disk-shaped resin member on which a shaft insertion hole 1, a locking hole 2*a* for a small diameter, a locking hole 2*b* for a large diameter, a spring hole 3*a* for a small diameter, a spring hole 3*b* for a large diameter, and the like are formed.

Figure 2A:
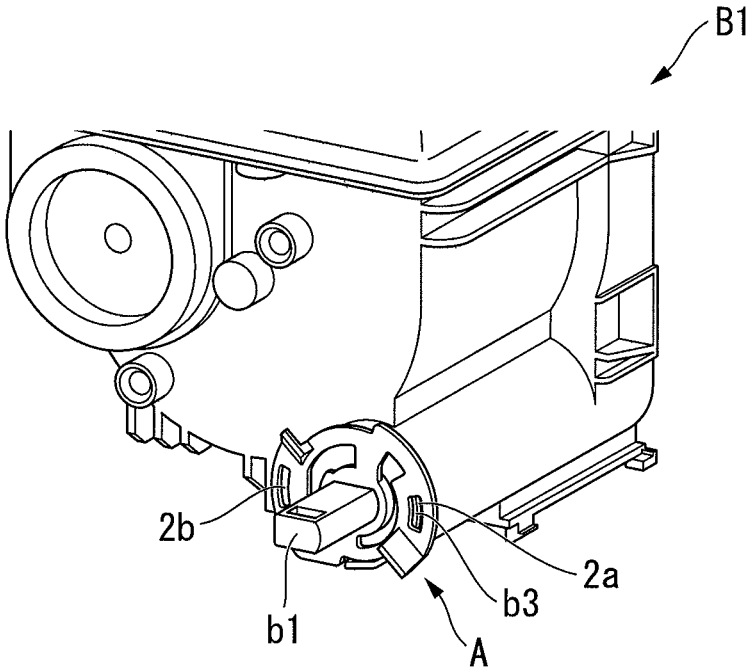
FIG. 2A is a perspective view showing a lock plate A (a rotation restricting member) attached to a toner container B1 with a small diameter according to a preferred embodiment of the present invention.
Figure 2B:
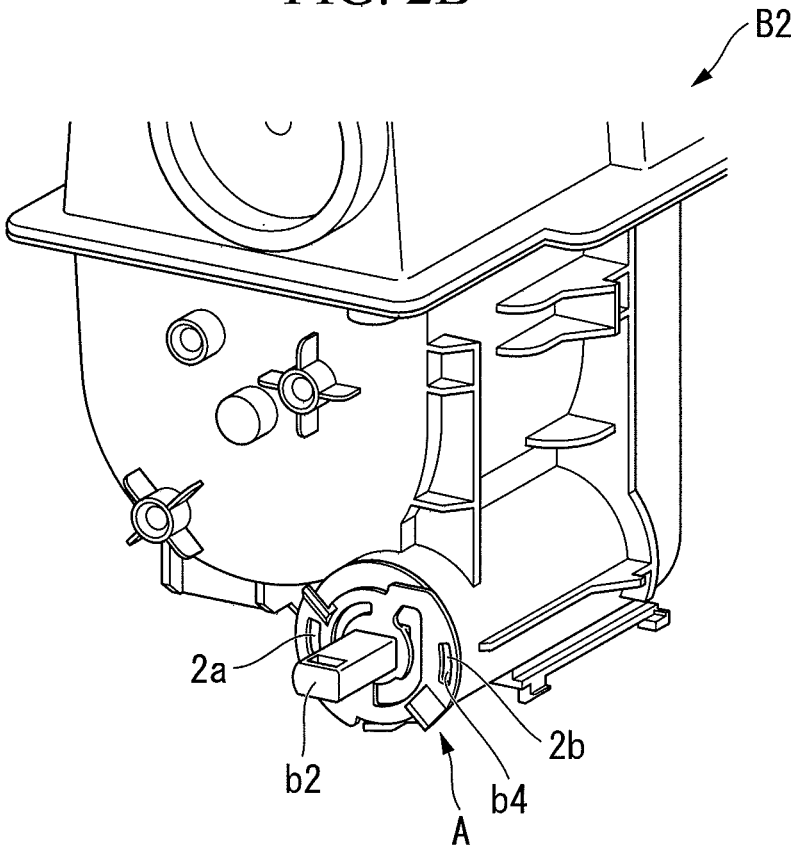
FIG. 2B is a perspective view showing a lock plate A (a rotation restricting member) attached to a toner container B2 with a large diameter according to a preferred embodiment of the present invention.

As shown in FIG. 1, the shaft insertion hole 1 has a shape which is asymmetric with respect to a center axis shown in a dashed line. In other words, the shaft insertion hole 1 is formed by three straight line portions 1*a*-1*c* and one circular arch portion 1*d* connecting the straight line portions 1*a* and 1*c* in a circular arch shape. Among the three straight line portions 1*a*-1*c* and the circular arch portion 1*d*, the straight line portions 1*a* and 1*c* are set in respective positions that face each other, and the straight line portion 1*b* and the circular arch portion 1*d* are set in respective positions that face each other. In the shaft insertion hole 1 with such shape, as shown in FIGS. 2A and 2B, the rotation shaft b1 of the toner container B1 with a small diameter (a mechanical device) or the rotation shaft b2 of the toner container B2 with a large diameter (a mechanical device) is inserted with a predetermined angular relationship.

More specifically, the rotation shafts b1 and b2 are rod-shape members whose cross-sectional shapes have the same shape as the shaft insertion hole 1 described above. Therefore, the shaft insertion hole 1 is formed such that the rotation shafts b1 and b2 can be inserted only with a predetermined angular relationship around a center axis of its own, that is, a center axis of the rotation shafts b1 and b2. In particular, an angle for which the lock plate A is inserted into the rotation shaft b1 of the toner container B1 with a small diameter is inverted 180 degrees with respect to an angle for which the lock plate A is inserted into the rotation shaft b2 of the toner container B2 with a large diameter.

Here, in the toner container B1 with a small diameter, a screw diameter of a spiral roller provided within the toner container B1 is smaller than a screw diameter of a spiral roller provided within the toner container B2 with a large diameter. The rotation shafts b1 and b2 described above are the rotation shafts of the rotation shutter described below provided within such toner container B1 with a small diameter or toner container B2 with a large diameter.

The locking hole 2*a* for a small diameter is, as shown in FIG. 1, a long hole provided at a side of the circular arch portion 1*d*. The straight line portion 1*b* and the circular arch portion 1*d* are located on opposite sides of the center axis of the shaft insertion hole 1 and face each other. When seen from a center axis set as a reference, the locking hole 2*a* with a small diameter is formed to be set at a side of the circular arch portion 1*d* outside of the shaft insertion hole 1. As shown in FIG. 2A, such locking hole 2*a* for a small diameter is inserted into a protruded portion b3 for a small diameter (an engaging portion) with a lock plate A being mounted on the rotation shaft b1 of the toner container B1 with a small diameter. The protruded portion b3 for a small diameter is formed at a portion away from the rotation shaft with a predetermined distance at the toner container B1 with a small diameter. The locking hole 2*a* with a small diameter restricts rotation of the rotation shaft b1 by engaging with the protruded portion b3 for a small diameter.

The locking hole 2*b* for a large diameter is, as shown in FIG. 1, a long hole provided at a side of the straight line portion 1*b*. The straight line portion 1*b* and the circular arch portion 1*d* are located on opposite sides of the center axis of the shaft insertion hole 1 and face each other. When seen from the center axis set as a reference, the locking hole 2*b* with a large diameter is formed to be set at a side of the straight line 1*b* outside of the shaft insertion hole 1. In particular, the locking hole 2*b* for a large diameter is positioned 180 degrees different from the locking hole 2*a* for a small diameter described above. As shown in FIG. 2B, in such locking hole 2*b* for a large diameter, a protruded portion b4 for a large diameter (an engaging portion) is inserted with a lock plate A being mounted on the rotation shaft b2 of the toner container B2 with a large diameter. The protruded portion b4 for a large diameter is formed at a portion away from the rotation shaft b2 with a predetermined distance at the toner container B2 with a large diameter. The locking hole 2*b* with a large diameter restricts rotation of the rotation shaft b2 by engaging with the protruded portion b4 for a large diameter.

Here, the locking hole 2*a* for a small diameter and the locking hole 2*b* for a large diameter are formed so as to be away from the center axis and each has a different distance from the center axis. The locking hole 2*a* for a small diameter is set in a position and/or has a shape that does not allow the insertion of the protruded portion b4 for a large diameter formed on the toner container B2 with a large diameter and that allows the insertion of only the protruded portion b3 for a small diameter formed on the toner container B1 with a small diameter. On the other hand, the locking hole 2*b* for a large diameter is set in a position and/or has a shape that does not allow the insertion of the protruded portion b3 for a small diameter formed on the toner container B1 with a small diameter and that allows the insertion of only the protruded portion b4 for a large diameter formed on the toner container B2 with a large diameter.

As shown in FIG. 1, when seen from the center axis set as a reference, the spring hole 3*a* for a small diameter is a long hole extending with a relatively large angle range between the circular arch portion 1*d* and the locking hole 2*a* for a small diameter. When the locking hole 2*a* for a small diameter is engaged with the protruded portion b3 for a small diameter formed on the toner container B1 with a small diameter as described above, such spring hole 3*a* for a small diameter is provided in order to apply a certain amount of elasticity to the lock plate A so as to prevent the lock plate A from collapsing when a certain amount of rotation force is applied to the rotation shaft b1.

As shown in FIG. 1, when seen from the center axis set as a reference, the spring hole 3*b* for a large diameter is a long hole extending with a relatively large angle range between the straight line portion 1*b* and the locking hole 2*b* for a large diameter. When the locking hole 2*b* for a large diameter is engaged with the protruded portion b4 for a large diameter formed on the toner container B2 with a large diameter as described above, such spring hole 3*b* for a large diameter is provided in order to apply a certain amount of elasticity to the lock plate A so as to prevent the lock plate A from collapsing when a certain amount of rotation force is applied to the rotation shaft b2.

Next, an example of a schematic structure of a copy machine (an image forming device) S including a toner container 70 to which such lock plate A is applied is described with reference to FIGS. 3 and 4.

Figure 3:
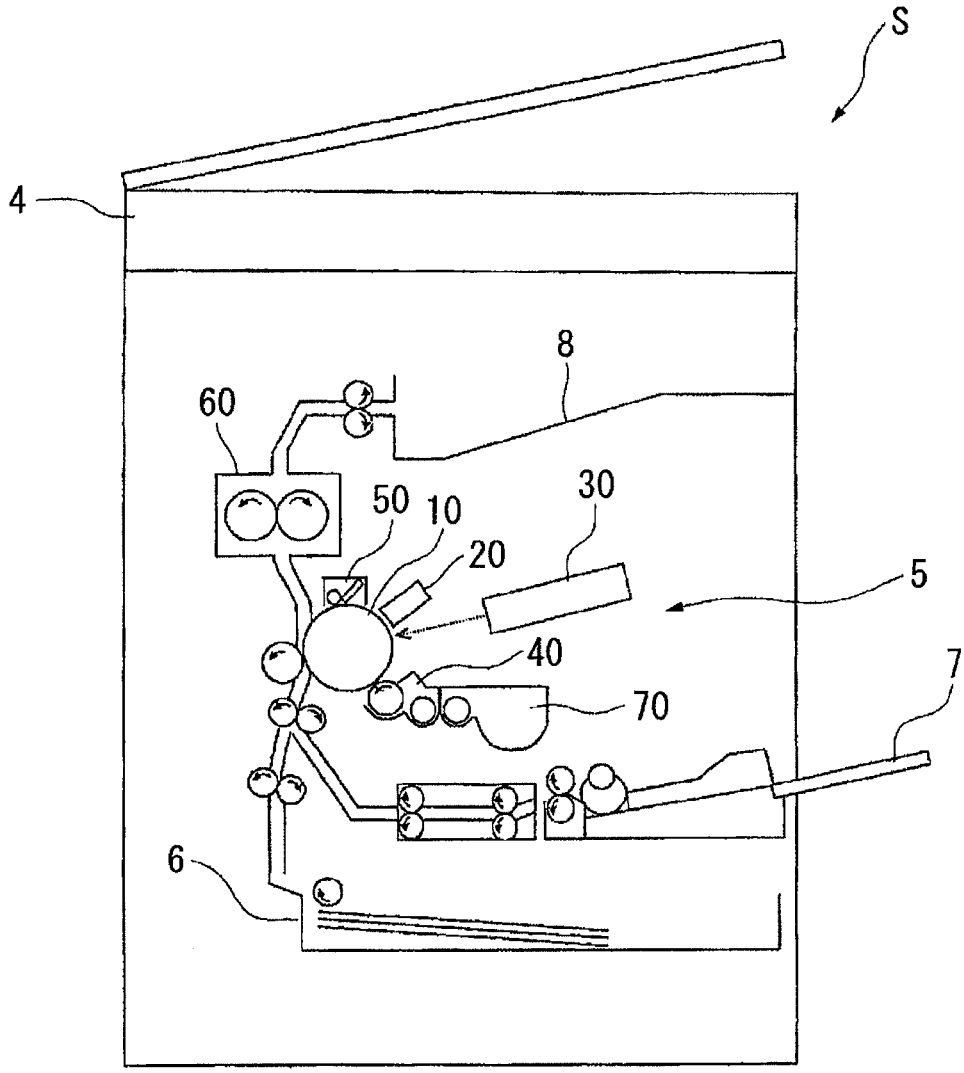
FIG. 3 is a schematic view schematically showing a structure of a copy machine S to which a lock plate A according to a preferred embodiment of the present invention is applied.

As shown in FIG. 3, the copy machine S includes an image reading unit 4, a print unit 5, a paper cassette 6, a feed tray 7, a discharge tray 8, and the like. The image reading unit 4 optically reads an image of a script placed on a platen. The print unit 5 prints the script image read by the above-described image reading unit 4 to a piece of paper. The paper cassette 6 stores a number of pieces of paper. The feed tray 7 is a paper holding unit that holds one or several pieces of paper fed manually by an operator. The discharge tray 8 is a paper holding unit that holds the paper after the printing is performed. In such copy machine S, the paper is supplied from the paper cassette 6 or the feed tray 7 to the print unit 5, and by the print unit 5, the script image read by the image reading unit 4 is printed on the paper. Then, the paper after printing is discharged from the print unit 5 to the discharge tray 8.

The print unit 5 is now described in more detail. The print unit 5 includes, as shown in FIG. 3, a photosensitive drum (a photoreceptor) 10, an electrostatic charge unit 20, a laser scanning unit 30, a developing unit 40, a cleaning unit 50, a fusing unit 60 and toner container 70.

Regarding the photosensitive drum 10, a periphery thereof is formed of a predetermined sensitive material, and an electrostatic latent image and a toner image based on the electrostatic latent image are formed on the periphery. The electrostatic charge unit 20 is arranged so as to face the photosensitive drum 10, and by the unit 20, the periphery of the photosensitive drum 10 is charged. The laser scanning unit 30 applies a laser beam generated based on the script image to the periphery of the photosensitive drum 10 in a scanning manner. By the electrostatic charge unit 20, the periphery of the photosensitive drum 10 is charged. In addition, by the laser scanning unit 30, the laser beam is scanned on the periphery of the charged photosensitive drum 10, and thereby, the electrostatic latent image based on the script image is formed on the periphery of the photosensitive drum 10.

Figure 4:
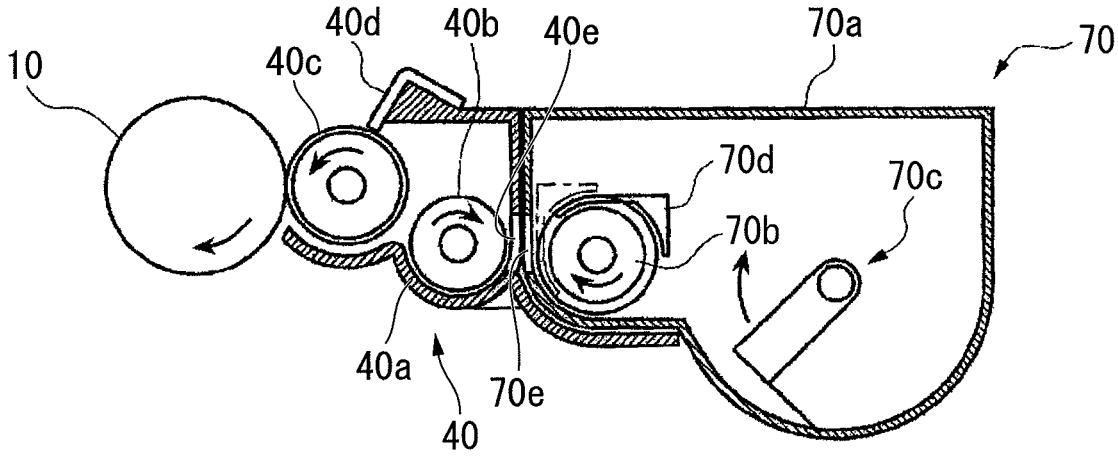
FIG. 4 is a cross-sectional view showing a structure of a toner container 70 of the copy machine S described above.

As shown in FIG. 4, the developing unit 40 includes a hollow housing 40*a*, the spiral roller 40*b* for the developing unit, a developing roller 40*c*, and a blade 40*d*. The toner is supplied to the periphery of the photosensitive drum 10 from a toner container 70 through an opening 40*e* formed at the housing 40*a* to develop the above-described electrostatic latent image as a toner image. The toner image formed on the periphery of the photosensitive drum 10 in this manner is transferred to a surface of the paper supplied from the paper cassette 6 or the feed tray 7.

The cleaning unit 50 is arranged so as to face the photosensitive drum 10, and removes the toner remaining on the photosensitive drum 10 after the toner image is transferred from the photosensitive drum 10 to the paper as described above. The fusing unit 60 fuses the toner on the paper by adding heat and pressure to the paper.

The toner container 70 is structured so as to be removable with respect to the copy machine S, and includes a hollow housing 70*a*, a spiral roller 70*b*, an agitator 70*c*, and a rotation shutter 70*d*. Such toner container 70 stores a certain amount of toner in the housing 70*a* as contents thereof, and supplies the toner to the developing unit 40 through an opening 70*e* formed at the housing 70*a*. In particular, the opening 70*e* of the toner container 70 and the opening 40*e* of the above-described developing unit 40 have a positional relationship that faces each other when the toner container 70 is mounted normally to the copy machine S, and the toner in the toner container 70 is supplied to the developing unit 40 through these openings 40*e* and 70*e*.

Additionally, the spiral roller 70*b* is provided in the vicinity of the opening 70*e* in the housing 70*a*, and a spiral blade is formed at a periphery of the spiral roller 70*b*. While stirring the toner by rotating around the shaft as shown by an arrow, the spiral roller 70*b* discharges the toner from the opening 70*e* toward the opening 40*e* of the developing unit 40. Note that a screw diameter of such spiral roller 70*b* is different in accordance with the different specifications of the toner container 70, for the above-described toner container B1 with a small diameter and the toner container B2 with a large diameter. The agitator 70*c* is formed in the housing 70*a*, and rotates within the housing 70*a* as shown by an arrow, and thereby, the toner in the housing 70*a* is discharged toward the spiral roller 70*b*.

The rotation shutter 70*d* restricts the discharge of the toner in the housing 70*a* from the opening 70*e* by rotating around the rotation shaft (corresponding to the above-described rotation shafts b1 and b2) that is concentrically provided with respect to the shaft of the spiral roller 70*b* described above. In particular, regarding the rotation shutter 70*d*, the solid line shows a state where the opening 70*e* is opened, i.e., a state for which the discharge of the toner from the opening 70*e* is allowed. On the other hand, the dashed line of the rotation shutter 70*d* shows a state where the opening 70*e* is closed, i.e., a state for which the discharge of the toner from the opening 70*e* is blocked.

Here, the toner container 70 shown in FIG. 4 does not have exactly the same shape as the shape of the toner container B1 with a small diameter or the toner container B2 with a large diameter B2 shown in FIG. 2A or 2B. However, the internal structure thereof is basically the same. The present lock plate A restricts the discharge of the contained toner to outside by the rotation of the rotation shutter 70*d* at the previous stage that such toner container 70 is mounted on the copy machine S, that is, for example, at the stage that the copy machine S is packed and delivered.

Next, the operation and effect of the lock plate A according to the present preferred embodiment is described in detail.

As shown in FIGS. 2A and 2B, the rotation shaft b1 of the toner container B1 with a small diameter and the rotation shaft b2 of the toner container B2 with a large diameter are formed to have the same shape as the shape of the shaft insertion hole 1 of the lock plate A. Specifically, the rotation shaft b1 and the rotation shaft b2 are structured by three straight line portions and one circular arch portion similarly to the shaft insertion hole 1.

Additionally, regarding the toner container B1 with a small diameter, as shown in FIG. 2A, the locking hole 2*a* for a small diameter of the lock plate A is inserted into the protruded portion b3 for a small diameter to restrict the rotation of the rotation shaft b1 only when a rotation angle of the rotation shaft b1 is set such that the circular arch portion of the rotation shaft b1 faces the protruded portion b3 for a small diameter. The toner container B1 with a small diameter is in a state that the supply of the internal toner to the outside is blocked, i.e., the rotation shutter is in a closed state, when the rotation shaft b1 is in a rotation state where the circular arch portion of the rotation shaft b1 faces the protruded portion b3 for a small diameter.

On the other hand, regarding the toner container B2 with a large diameter, as shown in FIG. 2B, the locking hole 2*b* for a large diameter of the lock plate A is inserted into the protruded portion b4 for a large diameter to restrict the rotation of the rotation shaft b2 only when a rotation angle of the rotation shaft b2 is set such that the side of the straight line portion 1*b* of the rotation shaft b2 faces the protruded portion b4 for a large diameter. The toner container B2 with a large diameter is in a state that the supply of the internal toner to outside is blocked, i.e., the rotation shutter is in a closed state, when the rotation shaft b2 is in a rotation state where the side of the straight line portion 1*b* of the rotation shaft b2 faces the protruded portion b4 for a large diameter.

Particularly, regarding the toner container B1 with a small diameter, the lock plate A is normally attached to the toner container B1 with a small diameter only when a rotation angle of the rotation shaft b1 is set such that the circular arch portion of the rotation shaft b1 faces the protruded portion b3 for a small diameter. On the other hand, regarding the toner container B2 with a large diameter, the lock plate A is normally attached to the toner container B2 with a large diameter only when a rotation angle of the rotation shaft b2 is set such that the side of the straight line portion 1*b* of the rotation shaft b2 faces the protruded portion b4 for a large diameter. In other words, the lock plate A is not normally attached to the toner container B1 with a small diameter when the side of the straight line portion 1*b* of the rotation shaft b1 faces the protruded portion b3 for a small diameter. On the other hand, the lock plate A is not normally attached to the toner container B2 with a large diameter when the circular arch portion of the rotation shaft b2 faces the protruded portion b4 for a large diameter.

As just described, when the lock plate A is normally attached to the toner container B1 with a small diameter or the toner container B2 with a large diameter, according to the toner container B1 with a small diameter or the toner container B2 with a large diameter, either the locking hole 2*a* for a small diameter or the locking hole 2*b* for a large diameter is engaged with the protruded portion b3 for a small diameter or the protruded portion b4 for a large diameter, to restrict the rotation of the rotation shaft b1 or the rotation shaft b2, in particular, to restrict the opening or closing of the rotation shutter.

Therefore, according to such lock plate A, the lock plate A can be commonly used for a toner container with different specifications such as the toner container B1 with a small diameter or the toner container B2 with a large diameter, and thereby, it is possible to realize cost reduction. Additionally, by preventing erroneous attachment to the toner container B1 with a small diameter and the toner container B2 with a large diameter, the rotation of each rotation shutter at the toner container B1 with a small diameter and the toner container B2 with a large diameter can be reliably restricted.

Note that the present invention is not limited to the preferred embodiment described above, and for example, modified examples such as described below can be provided.

(1) In the preferred embodiments described above, the lock plate A is structured so as to be compatible for the toner container with two different specifications such as the toner container B1 with a small diameter and the toner container B2 with a large diameter. However, when more locking holes are provided at different angles around the center axis, it is possible to be compatible for toner containers with three or more different specifications. For example, when locking holes are provided at different angles of 90 degrees apart around the center axis, it is possible to be compatible for toner containers with four different specifications.

(2) Regarding the mechanical device according to the present invention, it is not limited to the toner container B1 with a small diameter and the toner container B2 with a large diameter of the preferred embodiments described above. The mechanical device according to the present invention may be any device as long as it includes a rotation shutter. For example, the mechanical device according to the invention may include a variety of tanks such as a water tank that is used for an ice maker of a refrigerator.

INDUSTRIAL APPLICABILITY

Particularly, with a toner container of copy machine, it is possible to reduce the total cost and prevent erroneous attachment.

The invention claimed is:

1. A rotation restricting member comprising:

a rotation shaft that is inserted into a shaft insertion hole with a predetermined angular relationship; and a plurality of rotation restriction portions, each of which is formed at a different position around the shaft insertion hole and performs a rotation restriction function of the rotation shaft by engaging with an external portion, wherein the shaft insertion hole is set to have a shape of the rotation shaft and is formed around the rotation shaft with a different angle corresponding to the shape of the rotation shaft to allow any of the plurality of rotation restriction portions to engage with the external portion, and wherein a spring hole for applying elasticity is provided corresponding to the rotation restriction portions.

2. The rotation restricting member according to claim 1, wherein the rotation restriction portions are formed at two different positions around the shaft insertion hole.

3. A mechanical device comprising:

the rotation restricting member according to claim 2;

a rotation shaft that is inserted into the shaft insertion hole of the rotation restricting member; and an engaging portion that engages with any of the plurality of rotation restriction portions while the rotation shaft is inserted into the insertion hole.

4. The mechanical device according to claim 3 comprising a rotation shutter that discharges contents by rotation of the rotation shaft.

5. The mechanical device according to claim 4, wherein the mechanical device is a toner container.

6. An image forming device comprising the mechanical device according to claim 5.

7. A mechanical device comprising:

the rotation restricting member according to claim 1;

a rotation shaft that is inserted into the shaft insertion hole of the rotation restricting member; and an engaging portion that engages with any of the plurality of rotation restriction portions while the rotation shaft is inserted into the insertion hole.

8. The mechanical device according to claim 7 comprising a rotation shutter that discharges contents by rotation of the rotation shaft.

9. The mechanical device according to claim 8, wherein the mechanical device is a toner container.

10. An image forming device comprising the mechanical device according to claim 9.

* * * * *